US007137348B2

(12) United States Patent
Kamio et al.

(10) Patent No.: US 7,137,348 B2
(45) Date of Patent: Nov. 21, 2006

(54) SMALL WATERCRAFT

(75) Inventors: Kunihiko Kamio, Kobe (JP); Takahide Komoriya, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/043,694

(22) Filed: Jan. 25, 2005

(65) Prior Publication Data

US 2005/0161931 A1 Jul. 28, 2005

(30) Foreign Application Priority Data

Jan. 28, 2004 (JP) ..... 2004-020395

(51) Int. Cl.
*B63H 25/04* (2006.01)

(52) U.S. Cl. ..... 114/144 R

(58) Field of Classification Search ..... 114/144 R, 114/55.52; 74/493; 280/775
See application file for complete search history.

(56) References Cited

U.S. PATENT DOCUMENTS 4,726,311 A 2/1988 Niina
5,524,927 A * 6/1996 Toussaint ..... 280/777
2004/0261565 A1* 12/2004 Uphaus et al. ..... 74/493

FOREIGN PATENT DOCUMENTS

| | | |
|---|---|---|
| JP | 61-229690 | 10/1986 |
| JP | 61-275095 | 12/1986 |
| JP | 02-105099 | 4/1990 |

* cited by examiner

*Primary Examiner*—Ed Swinehart
(74) *Attorney, Agent, or Firm*—Alleman Hall McCoy Russell & Tuttle LLP

(57) ABSTRACT

A steering device of a small watercraft is disclosed. The device includes a steering column oriented substantially in the vertical direction, wherein the steering column includes an upper component and a lower component, the components being coupled together so as to be movable relative to each other in the longitudinal direction thereof, and a fastening device configured to lock the relative movement of the components. One of the components includes an elongated hole which penetrates in the left-and-right direction and is elongated in the vertical direction. The other component includes a protrusion extended in the left-and-right direction so as to be accommodated in the elongated hole and to be guided by the hole in the vertical direction. The components each include a contact surface having a plurality of teeth arranged in the vertical direction, and engage with each other in the front-and-rear direction by engaging the teeth.

11 Claims, 6 Drawing Sheets

SMALL WATERCRAFT

TECHNICAL FIELD

The present invention relates to an adjustable steering device of a small watercraft, more particularly, to a steering device in which linear extension and contraction, as well as tilt are possible.

BACKGROUND OF THE INVENTION

Unexamined Patent Publication No. SHO 61-229690, Unexamined Patent Publication No. SHO 61-275095, U.S. Pat. No. 4,726,311 and Unexamined Utility Model Publication No. HEI 2-105099 disclose adjustable steering devices or structures of small watercraft. Each steering device is configured to be adjustable for a physique or riding posture of an operator, or a storage space. The steering devices include a steering column and the steering column is typically configured to be dividable in two parts, an upper steering column component and a lower steering column component, substantially in the vertical direction. The upper steering column component and the lower steering column component are coupled together with a telescopic mechanism or a tilt mechanism.

The disclosed techniques in Unexamined Patent Publication No. SHO 61-229690, U.S. Pat. No. 4,726,311, and Unexamined Utility Patent Publication No. HEI 2-105099 include a tilt mechanism, however, they do not include a telescopic mechanism. On the other hand, the disclosed technique in the Unexamined Patent Publication No. SHO 61-275095 includes a telescopic mechanism, however, it does not include a tilt mechanism. Thus, the prior art references only disclose either one of the adjusting mechanisms and do not suggest or teach the combination of the both mechanisms.

The telescopic function is advantageous when adjusting for physique and riding posture of an operator. On the other hand, the tilt function is advantageous when transporting watercraft with height restrictions. For this reason, a steering device including both telescopic function and tilt function has been desired.

BRIEF SUMMARY OF THE INVENTION

The present invention addresses the above-mentioned conditions, and one aspect of the present invention is to provide an improved steering device of a small watercraft.

The steering device comprises a steering column oriented substantially in the vertical direction, wherein the steering column includes an upper steering column component and a lower steering column component. The upper steering column component and the lower steering column component are coupled together so as to be movable relative to each other in the longitudinal direction of the steering column. One of the steering column components includes a first elongated hole which penetrates in the left-and-right direction and is elongated in the vertical direction, and the other steering column component includes a protrusion extended in the left-and-right direction so as to be accommodated in the first elongated hole and to be guided by the first elongated hole in the vertical direction. The steering column components each include a contact surface having a plurality of engaging teeth arranged in the vertical direction. The steering column components engage with each other in the front-and-rear direction by engaging the engaging teeth, and a fastening device configured to lock the relative movement of the steering column components.

In one aspect of the present invention, the steering device is configured to achieve both a telescopic function and a tilt function with a single integrated mechanism.

It is preferable that the steering column components may be configured to be relatively tiltable around the protrusions and the tilting of the steering column components may be restricted by the fastening device.

Preferably, the fastening device may be configured to perpendicularly penetrate the contact surfaces.

Preferably, one of the steering column components may include a second elongated hole which penetrates the one of the steering column components in the front-and-rear direction and elongate in the vertical direction, the fastening device being inserted through the second elongated hole.

Preferably, the tilting of the steering column components may be enabled by loosening the fastening device.

Preferably, the steering column components may be each configured to be in substantially a channel shape opened in a transverse cross-section, substantially in the longitudinal direction of the watercraft, and may be configured so that a portion of one component is inside a portion of the other. One of the contact surfaces may be provided in a front surface of a web portion of one of the channel-shaped steering column components and the other contact surface may be provided on a rear surface of a web portion of the other channel-shaped steering column component. Further, the contact surfaces may be configured to be exposed when the steering column components are tilted.

Preferably, the steering column components may be oriented so that the channel shapes thereof are opened forward.

Preferably, the lower steering column component may be rotatably coupled with a body of the watercraft about the longitudinal axis thereof, and configured for an interlocking movement with a steering nozzle of the watercraft. A portion of the lower steering column component may be arranged inside a portion of the upper steering column component, and the upper steering column component may be configured to be movable in the longitudinal direction of the steering column and tiltable rearward, with respect to the lower steering column component.

The above and further objects and features of the invention will more fully be apparent from the following detailed description with accompanying drawings.

BRIEF DESCRIPTION OF THE SEVERAL VIEWS OF THE DRAWINGS

FIG. 3A shows the steering column is in a contracted state and FIG. 3B shows the steering column is in an extended state;

DETAILED DESCRIPTION OF THE INVENTION

The present invention will now be described in detail referring to the accompanying drawings illustrating the embodiments thereof.

Figure 1:
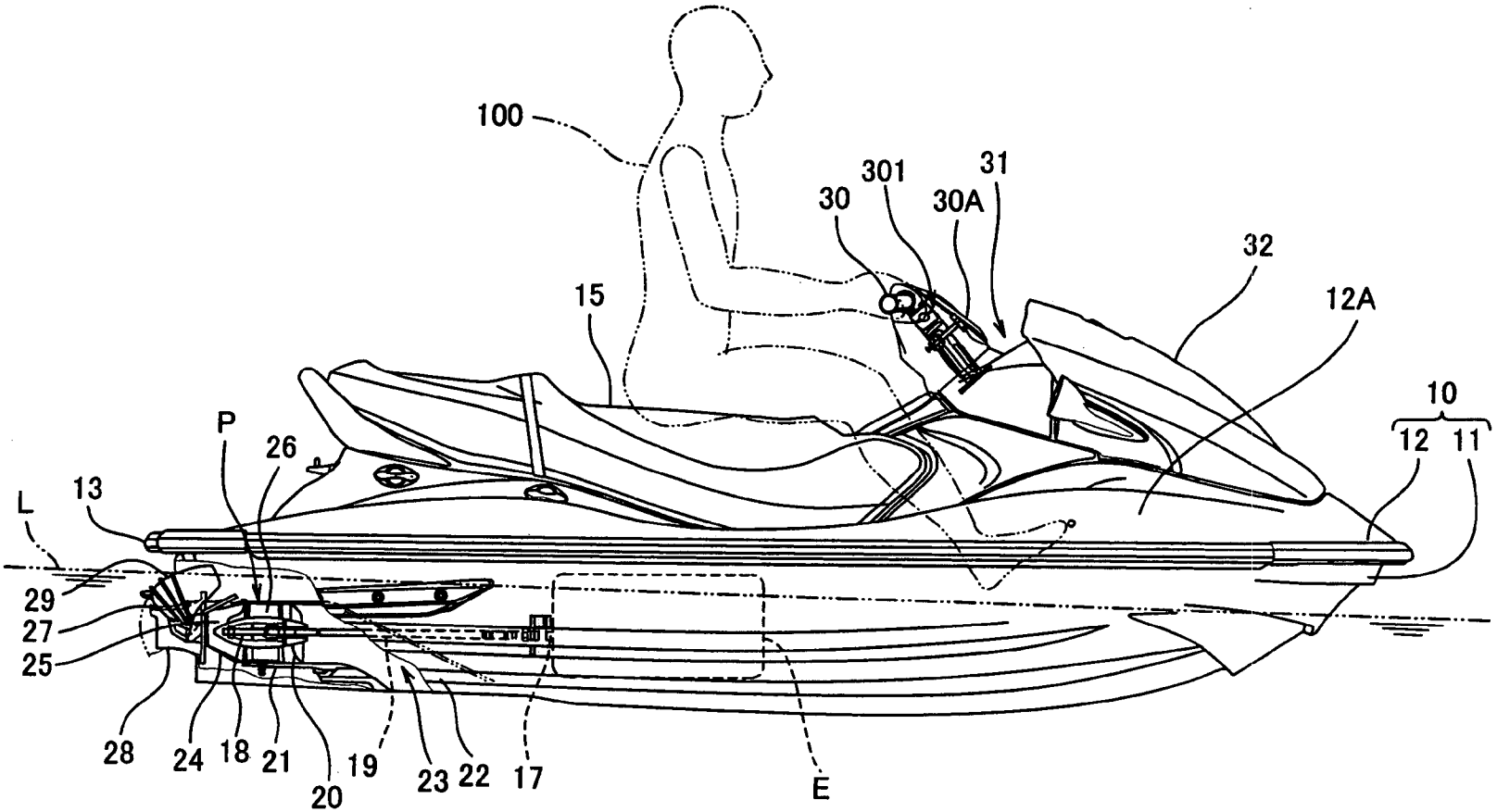
FIG. 1 is a side view showing an entire small watercraft of an embodiment according to the present invention, in which a steering column is contracted.
Figure 2:
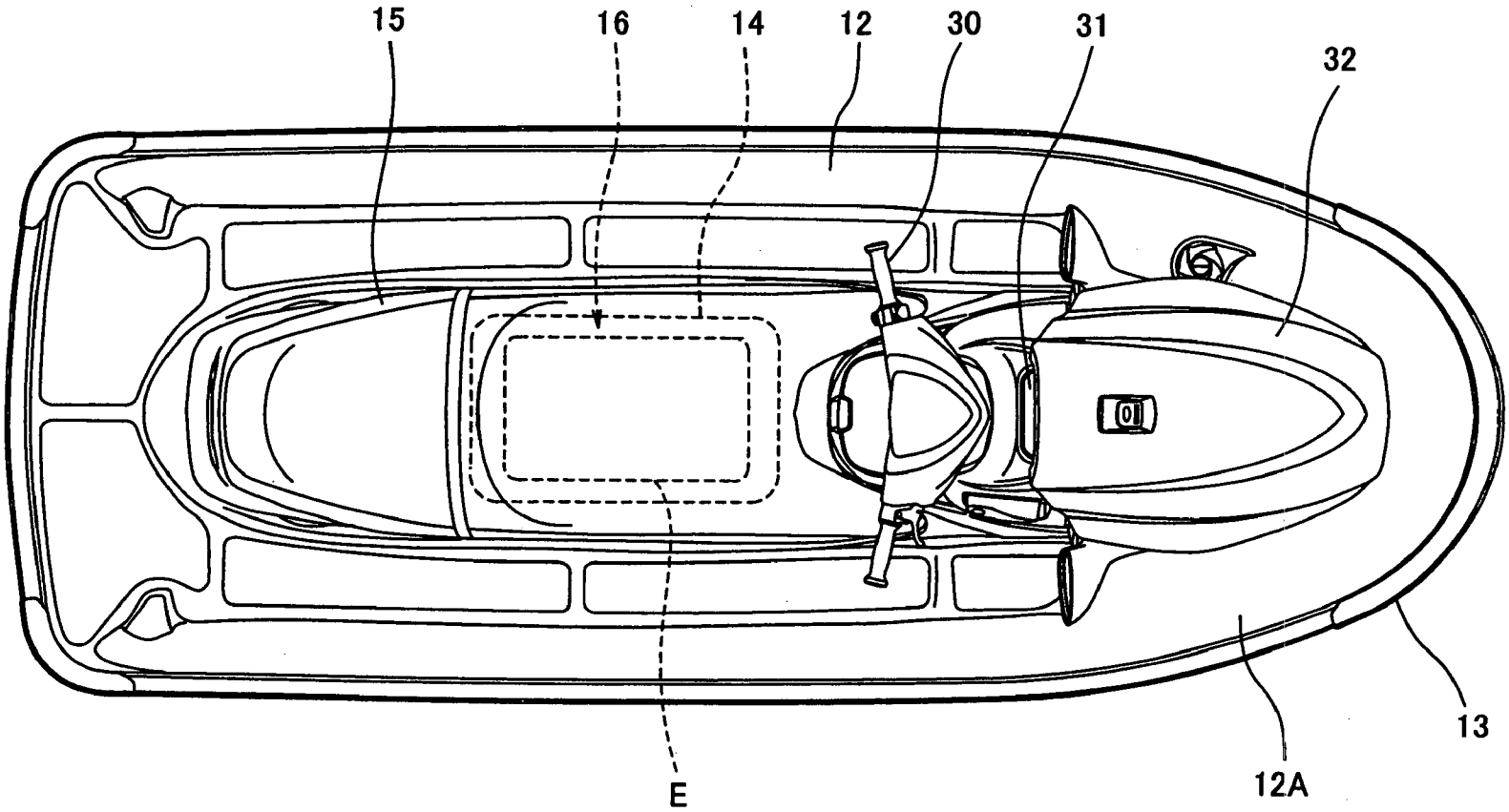
FIG. 2 is a plan view of FIG. 1.

FIG. 1 is a side view showing the entire small watercraft of an embodiment according to the present invention, and FIG. 2 is a plan view of the small watercraft shown in FIG. 1. In this embodiment, descriptions of direction are intended to address normal directions of the watercraft in a stationary condition. In FIGS. 1 and 2, a body 10 of the small watercraft includes a hull 11 and a deck 12 covering the hull 11 from above. The hull 11 and the deck 12 are connected each other at a gunnel line 13 which extends over the entire perimeter of the hull 11 and the deck 12. In this embodiment, the gunnel line 13 is normally located above a waterline L (which is shown in a two-dot dashed line in FIG. 1) of the small watercraft in the stationary condition.

As shown in FIG. 2, an opening 14 of substantially rectangular shape extending in the longitudinal direction of the watercraft is formed at slightly rear of the middle section of the deck 12. The opening 14 is covered from above by a seat 15 on which an operator straddles. An engine E is provided in a space (usually referred to as "an engine room") 16 surrounded by the hull 11 and the deck 12 below the seat 15.

As shown in FIG. 1, a crankshaft 17 of the engine E extends rearward, and a rear end portion of the crankshaft 17 is rotatably coupled integrally with a pump shaft 18 of a water jet pump P through a propeller shaft 19. An impeller 20 is attached on the pump shaft 18 of the water jet pump P. The impeller 20 is covered with a cylindrical pump casing 21 on the outer periphery thereof.

A water intake 22 is provided on the bottom of the hull 11. Water is sucked from the water intake 22 and fed to the water jet pump P through a water intake passage 23. The water jet pump P pressurizes and accelerates the water by rotation of the impeller 20. The pressurized and accelerated water is discharged through a pump nozzle 24 having a cross-sectional area of water flow gradually reduced rearward, and from an outlet port 25 provided on the rear end portion of the pump nozzle 24, thereby obtaining a thrust. In FIG. 1, a reference numeral 26 denotes fairing vanes for reducing turbulence in water flow behind the impeller 20.

As shown in FIGS. 1 and 2, a reference numeral 30 denotes a bar-type steering handle. The steering handle 30 operates in association with a steering nozzle 28 swingable around a swing shaft (not shown) to the right or to the left behind the pump nozzle 24. When the operator rotates the steering handle 30 clockwise (to the right) or counterclockwise (to the left), the steering nozzle 28 is swung toward the opposite direction so that the watercraft can be correspondingly turned to a desired direction.

As shown in FIG. 1, a bowl-shaped reverse deflector 29 is provided above the rear section of the steering nozzle 28 such that it can swing downward around a horizontally mounted swinging shaft 27. Thereby, the deflector 29 is swung to a lower position behind the steering nozzle 28 and the water discharged rearward from the steering nozzle 28 is deflected forward. Thus, switching of watercraft travel direction from forward to rearward can be performed.

In FIGS. 1 and 2, a multi-function meter 31 is provided in a front deck portion 12A in front of the steering handle 30. Further in the front deck portion 12A in front of the multi-function meter 31, a front hatch cover 32 is provided, extended from a front end portion proximate to a bow of the watercraft, to the multi-function meter 31. The multi-function meter 31 is configured to display various information, such as travel speed of the watercraft.

The front hatch cover 32 is configured to be pivotable about an axis in the left-and-right direction (not shown) at a front end thereof. Opening and closing operation of the front hatch cover 32 about the axis is assisted by a spring-damper mechanism (not shown). The rear end portion of the hatch cover 32 extends slightly over the multi-function meter 31 so as to serve as a sunshade for the multi-function meter 31.

As shown in FIG. 1, the handle 30 substantially extended in the left-and-right direction is fixed to an upper end portion of the steering column 301. The steering column 301 is disposed in a column cover 30A and substantially extends in the vertical direction. In FIG. 1, the column cover 30A is shown as transparent so that the steering column 301 can be seen. Typically, the steering column 301 is disposed so as to be inclined rearward by a predetermined angle as shown in FIG. 1. A lower end portion of the steering column 301 is rotatably coupled about the longitudinal axis of the steering column 301 with the front deck portion 12A or a structural member therein. The steering column 301 is co-operably coupled with the steering nozzle 28. For example, the steering column 301 and the steering nozzle 28 are coupled by a suitable cable (not shown).

Figure 3B:
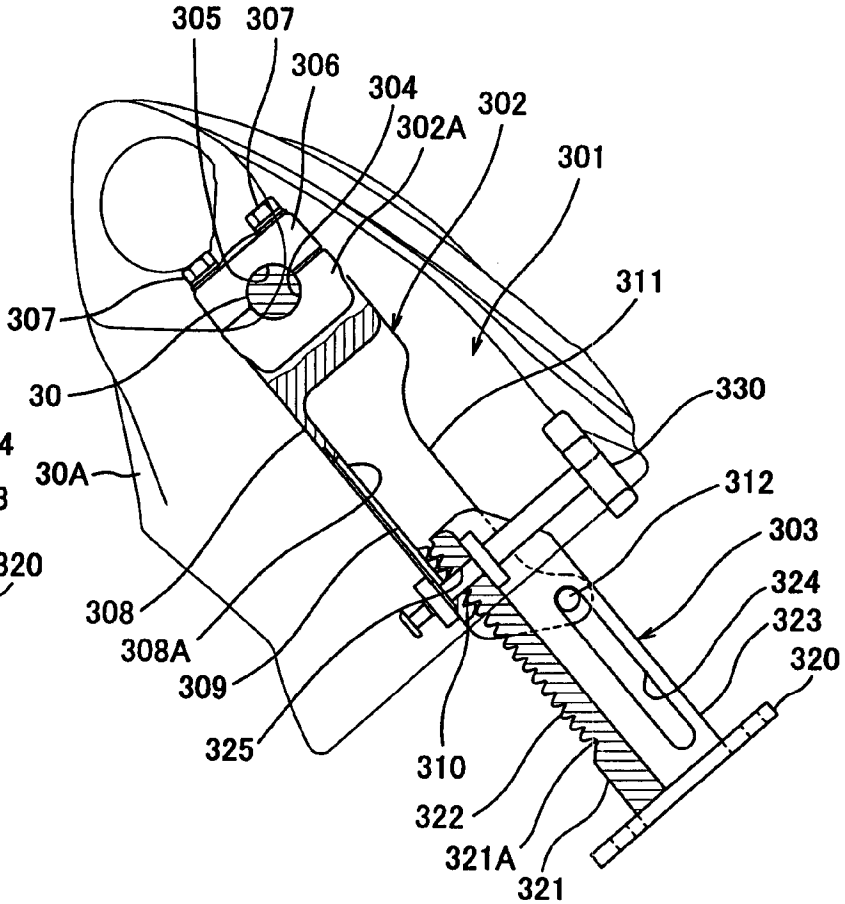
FIGS. 3A and 3B are partial, enlarged views showing the steering device of FIGS. 1 and 2, where
Figure 3A:
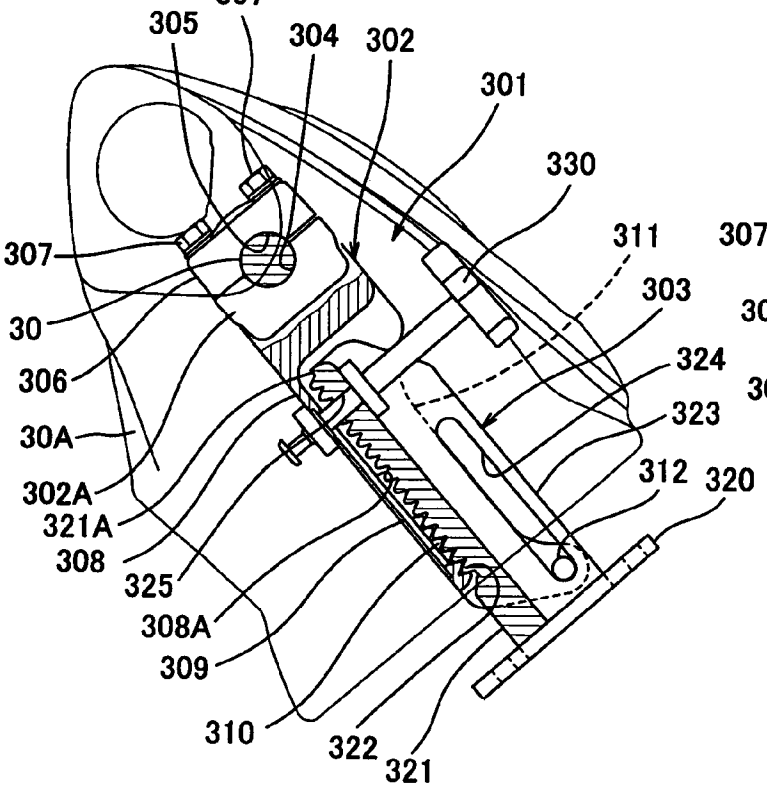

FIGS. 3A and 3B show a detailed configuration of the steering column 301. The steering column 301 is configured to be divided substantially in two components in the vertical direction (i.e., the longitudinal direction of the steering column 301 in this embodiment). As used herein, the upper part is referred to as "an upper steering column component" 302 and the lower part is referred to as "a lower steering column component" 303.

The upper steering column component 302 is typically formed in a channel shape opened forward in transverse cross-section. An upper end portion 302A of the upper steering column component 302 typically is formed in a brick shape extending in the left-and-right direction. In an upper surface of the upper end portion 302A, a groove 304 of a semicircular cross-section is formed so as to extend in the left-and-right direction. A central portion of the handle 30 is fitted in along the groove 304 and, then, from above, a handle holder 306 of a brick shape to which a similar groove 305 to the groove 304 is formed in an undersurface thereof is placed and covers the handle 30. The handle holder 306 is fastened onto the upper end portion 302A of the upper steering column component 302 with threaded fasteners 307.

A second elongated hole 309 is typically formed in a lower portion of the channel-shaped upper steering column component 302. More specifically, the second elongated hole 309 is formed in a rear wall portion (a web portion of the channel shape) 308 of the channel-shaped upper steering column component 302, facing rearward. The elongated hole 309 extends in the vertical direction. Two or more engagement teeth 310 are formed in a front surface (a contact surface with the lower steering column component 303) 308A of the rear wall portion 308 and allotted in the longitudinal direction of the upper steering column component 302.

Similarly, the lower steering column component 303 is typically formed in a channel shape opened forward in transverse cross-section. The lower steering column component 303 includes a flange portion 320 extended in the transverse cross-sectional direction at a lower end portion. The lower steering column component 303 is coupled with the front deck portion 12A or the structural member therein so as to be rotatable about the longitudinal axis thereof, as mentioned above.

Two or more engagement teeth 322 are formed in the channel-shaped lower steering column component 303. More specifically, the engagement teeth 322 are allotted in the longitudinal direction of the lower steering column component 303 and formed in a rear surface (a contact surface with the upper steering column component 302) 321A of a rear wall portion (a web portion of the channel shape) 321 of the channel-shaped lower steering column component 303 facing rearward. The engagement teeth 322 are configured to mate with the engagement teeth 310 of the upper steering column component 302.

In this embodiment, the engagement teeth 310 of the upper steering column component 302 are formed in a lower end portion on the front surface of the rear wall portion 308. On the other hand, the engagement teeth 322 of the lower steering column component 303 are formed along substantially an entire rear surface of the rear wall portion 321 in the vertical direction. Thereby, the engagement between the engagement teeth 310 and 322 is possible throughout an entire telescopic range of movement of the upper steering column component 302 and the lower steering column component 303, which movement will be explained in detail hereinafter.

A first elongated hole 324 elongated in the longitudinal direction of the lower steering column component 303 is formed in each of side wall portions (flange portions of the channel shape) 323 (only one side is illustrated) of the lower steering column component 303. The first elongated hole 324 may be formed as a penetrated hole or a concaved portion. Protrusions 312 extended in the left-and-right direction are formed in side wall portions 311 (only one side is illustrated) of the upper steering column component 302. The protrusions 312 are respectively accommodated in the elongated holes 324 so as to be guided by the elongated hole 324. The positions and elongated direction of the elongated hole pair are aligned in the left-and-right direction. The protrusions are also aligned in the left-and-right direction so as to be co-axial.

A fastening device 330 is inserted through a hole (typically, a circular hole) 325 formed in the rear wall portion 321 of the lower steering column component 303. The fastening device 330 further extends rearward through an elongated hole 309 formed in the upper steering column component 302. The elongated hole 309 elongates in the vertical direction. The fastening device 330 may be any fastening device with various shapes and of various fastening methods, as long as it can at least hold the upper steering column component 302 and the lower steering column component 303 together in the front-and-rear direction, and maintain the engagement between the engagement teeth 310 and 322 formed in the components 302 and 303. Therefore, the fastening device 330 may be simply realized by a bolt-and-nut mechanism.

In this embodiment, in order to join the upper steering column component 302 and the lower steering column component 303 together and, at the same time, to guide the components 302 and 303 in the vertical direction, a relationship between the protrusions and elongated holes may be reversed and the reversed relationship still can achieve similar functions. For example, the relationship between each of the protrusions 312 of the upper steering column component 302 and the corresponding elongated hole 324 of the lower steering column component 303 may be reversed, and the lower steering column component 303 may include a protrusion and the upper steering column component 302 may include a corresponding elongated hole. Further, the elongated hole may be replaced with a concavity, a groove or the like being capable of guiding the corresponding protrusion. Similarly, the relationship between the elongated hole 309 of the upper steering column component 302 and the hole 325 of the lower steering column component 303 through which the fastening device 330 is inserted may also be reversed and, the lower steering column component 303 may include an elongated hole and the upper steering column component 302 may include a hole (typically, a circular hole). Further, the elongated hole 309 formed in the upper steering column component 302 may be replaced with a plurality of holes spaced in the vertical direction.

FIG. 1 shows a most-shortened state of the steering column 301. In this state, it is possible for an operator 100 to take a normal riding posture seated on the seat 15. As shown in FIG. 3A, in this state, the fastening device 330 engages with an uppermost end portion of the elongated hole 309 of the upper steering column component 302 and, at the same time, the protrusions 312 of the upper steering column component 302 engage with lowermost end portions of the elongated holes 324 of the lower steering column component 303. The upper steering column component 302 and the lower steering column component 303 are maintained their engaged state of the engagement teeth 310 and 322 by the fastening device 330 and, thus, relative movement of the steering column components 302 and 303 is restrained.

In this embodiment, although the lower steering column component 303 is substantially fixed permanently to the front deck portion 12A or the structural member therein, except that rotational movement about the longitudinal axis thereof is permitted. On the other hand, when the fastening device 330 is loosened, the upper steering column component 302 can be tilted rearward around the protrusions 312 with respect to the lower steering column component 303. A tilt angle of the upper steering column component 302 depends on how much the fastening device 330 is loosened. When the engagement between the engagement teeth 310 and 322 is released, the upper steering column component 302 can be moved upward as the protrusions 312 are guided in the respective elongated holes 324 of the lower steering column component 303, with respect to the lower steering column component 303 and, thus, the steering column 301 can be in an extended state, as shown in FIG. 3B. When moving the upper steering column component 302 upward, the upper steering column component 302 is guided by the fastening device 330 which passes through the elongated hole 309 formed in the upper steering column component 302, the movement of the upper steering column component 302 is smooth, without slack in the left-and-right direction.

Figure 4:
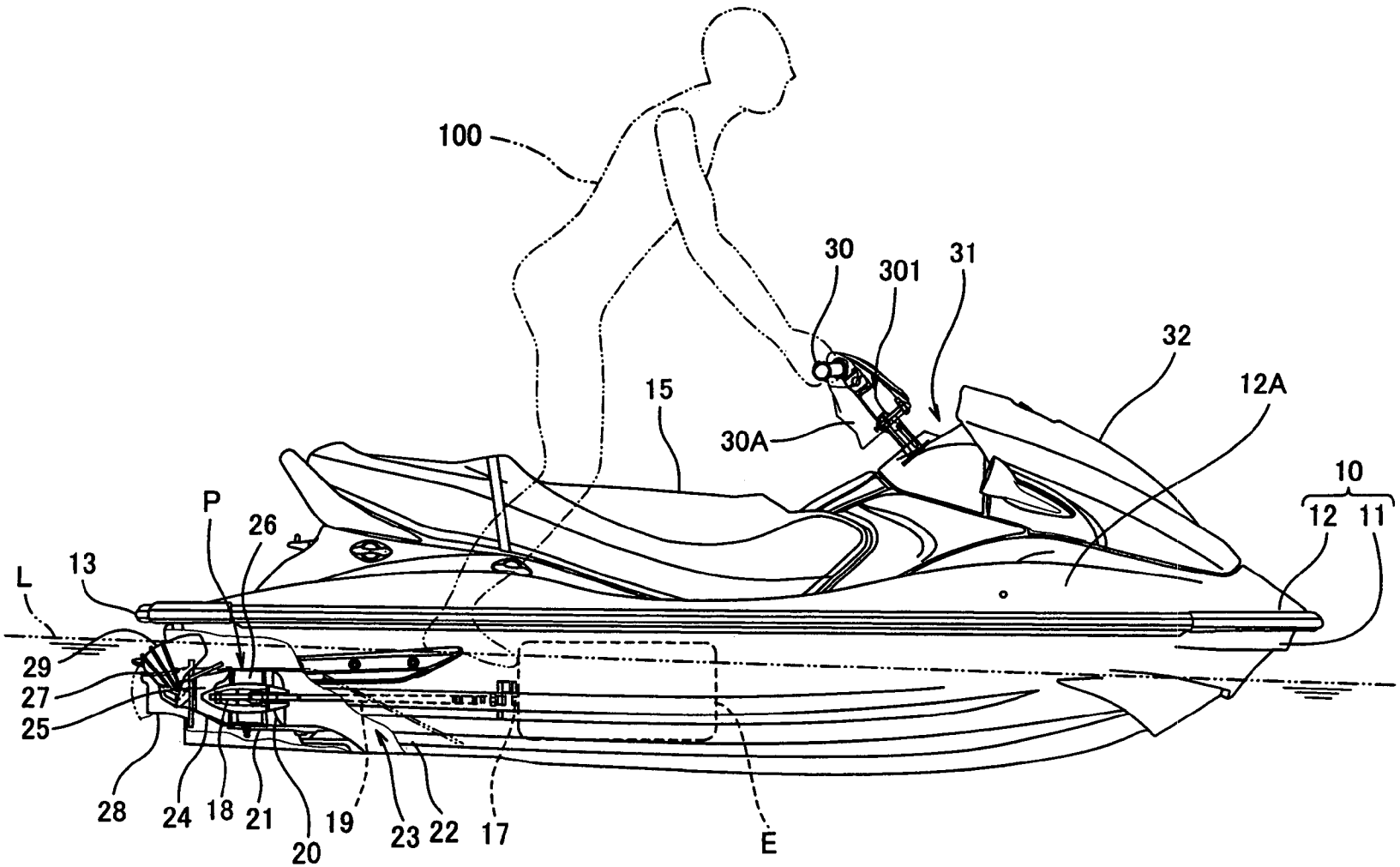
FIG. 4 is a side view showing an operator's riding posture in the extended state of the steering column as shown in FIG. 3B.

FIG. 3B shows the most extended state of the steering column 301. In this state, an operator 100 can take a riding posture standing from the seat 15 as shown in FIG. 4. By changing the engagement position of the engagement teeth 310 and 322, the extension length of the steering column 301 can be adjusted by changing a mating position of the engagement teeth 310 and 322 so as to be adapted for the operator's physique and riding posture.

As shown in FIG. 3B, the fastening device 330 engages with a lowermost end portion of the elongated hole 309 of the upper steering column component 302 and, at the same time, the protrusions 312 of the upper steering column component 302 engage with uppermost end portions of the elongated holes 324 of the lower steering column component 303. The upper steering column component 302 and the lower steering column component 303 are maintained their engaged state of the engagement teeth 310 and 322 by the fastening device 330 and, thus, a relative movement of the steering column components 302 and 303 is restrained.

To make the steering column 301 transition from the most extended state (FIG. 3B) to the most shortened state (FIG. 3A), the above process may be performed in reverse.

Figure 5:
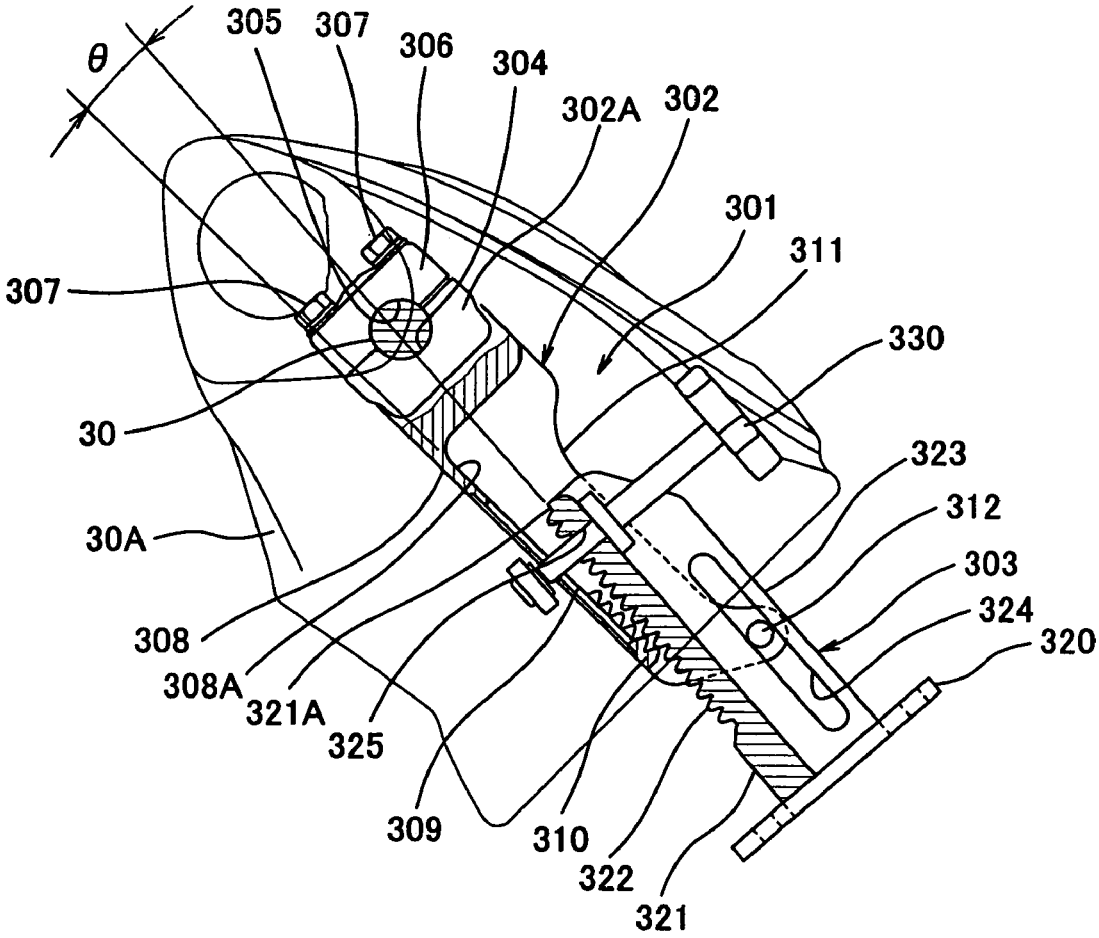
FIG. 5 is a partially enlarged view showing the steering device of FIGS. 1 and 2, in which the steering column is tilted.
Figure 6:
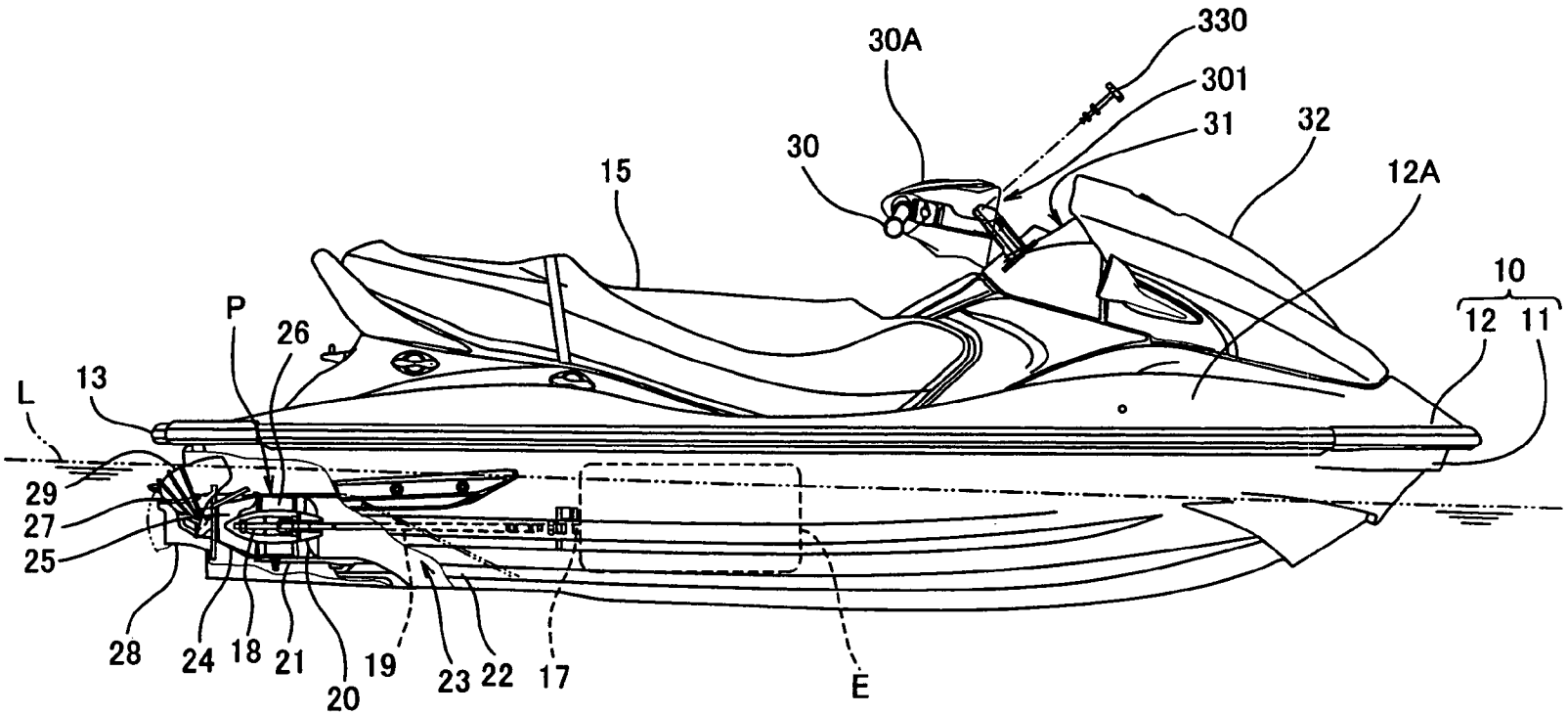
FIG. 6 is a side view showing the small watercraft in a storage state (a tilted state) with the steering column tilted as shown in FIG. 5.

As mentioned above, when the fastening device 330 is loosened, the upper steering column component 302 can be tilted rearward around the protrusions 312. This is always true within the extendable range of the steering column 301. Therefore, as shown in FIG. 5, the upper steering column component 302 can be tilted (inclined) rearward by an angle (i.e., a tilt angle) θ corresponding to the degree of loosening of the fastening device 330. If the fastening device 330 is removed as shown in FIG. 6, the tilt angle is maximized and a height of the handle 30 which is located in the highest position of the watercraft is minimized. Therefore, it is easier to store the watercraft in a vehicle with a roof, such as a van or a wagon, when transporting the watercraft with height restrictions. In FIG. 5, the tilt angle is shown as an angle between the contact surfaces 308A and 321A for only an explanation purpose.

As shown in FIG. 5, mutually contacting portions of the upper steering column component 302 and the lower steering column component 303 are each formed in a channel shape opened forward in transverse cross-section. Thus, when the upper steering column component 302 is completely tilted with respect to the lower steering column component 303 as shown in FIG. 6, both engaging surfaces of the engagement teeth 310 and 322 are exposed and, then, contamination such as sand or salt deposited on the engaging surfaces can be easily washed out with water. In this embodiment, although a transverse cross-section of each of the steering column components is formed in a channel shape, the transverse cross-section may be in any other suitable shapes such as a channel shape opened rearward or a semicircular shape, as long as telescopic and tilting operation of the upper steering column component 302 can be achieved easily as described above.

As the present invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

The invention claimed is:

1. A steering device of a small watercraft, comprising:

a steering column oriented to incline rearward with respect to a vertical direction, wherein the steering column includes an upper steering column component that is coupled with a steering handle of the watercraft at an upper end portion thereof, and a lower steering column component that is rotatably coupled with a body of the watercraft about the longitudinal axis thereof for interlocking movement with a steering nozzle of the watercraft, the upper steering column component and the lower steering column component are coupled together so as to be movable relative to each other in the longitudinal direction of the steering column, and to be rotatable together relative to the watercraft body; and a fastening device configured to selectively lock the relative longitudinal movement of the upper and lower steering column components;

wherein one of the upper and lower steering column components includes a first elongated hole which is concaved in a left-and-right direction and is elongated in the longitudinal direction of the steering column, the other of the upper and lower steering column component includes a protrusion extended in the left-and-right direction so as to be accommodated in the first elongated hole and to be guided by the first elongated hole in the longitudinal direction of the steering column; and wherein the upper and lower steering column components each include a contact surface having a plurality of engaging teeth arranged in the longitudinal direction of the steering column, the upper and lower steering column components being configured to engage with each other in a perpendicular direction to the longitudinal direction by engaging the engaging teeth, upon adjusting the fastening device to lock the relative movement of the upper and lower steering column components.

2. The steering device of claim 1, wherein the steering column components are configured to be relatively tiltable around the protrusion and a tilt angle of the steering column components is restricted by the fastening device.

3. The steering device of claim 2, wherein the fastening device is configured to perpendicularly penetrate the contact surfaces.

4. The steering device of claim 3, wherein one of the steering column components includes a second elongated hole which penetrates the one of the steering column components in the perpendicular direction to the longitudinal direction of the steering column and is elongated in the longitudinal direction of the steering column, the fastening device is inserted through the second elongated hole.

5. The steering device of claim 4, wherein the tilting of the steering column components is allowed by loosening the fastening device.

6. The steering device of claim 5, wherein the steering column components are each configured to be in substantially a channel shape opened in a transverse cross-section, substantially in the longitudinal direction of the watercraft, and configured so that a portion of one component is inside a portion of the other, and wherein one of the contact surfaces is provided in a front surface of a web portion of one of the channel-shaped steering column components and the other contact surface is provided on a rear surface of a web portion of the other channel-shaped steering column component, the contact surfaces are configured to be exposed when the steering column components are tilted.

7. The steering device of claim 6, wherein the steering column components are oriented so that the channel shapes thereof are opened forward.

8. The steering device of claim 6, wherein a portion of the lower steering column component is arranged inside a portion of the upper steering column component; and wherein the upper steering column component is configured to be movable in the longitudinal direction of the steering column and tiltable rearward, with respect to the lower steering column component.

9. A steering device of a small watercraft, comprising:

a steering column oriented to incline with respect to the vertical direction, wherein the steering column includes an upper steering column component and a lower steering column component, the upper steering column component and the lower steering column component being coupled together so as to be movable relative to each other in the longitudinal direction of the steering column; and a fastening device configured to lock the relative movement of the steering column components;

wherein one of the steering column components includes a first elongated hole which is concaved in the left-and-right direction and is elongated in the longitudinal direction of the steering column, and the other steering column component includes a protrusion extended in the left-and-right direction so as to be accommodated in the first elongated hole and to be guided by the first elongated hole in the longitudinal direction of the steering column;

wherein the steering column components each include a contact surface having a plurality of engaging teeth arranged in the longitudinal direction of the steering column, the steering column components being configured to engage with each other in the front-and-rear direction by engaging the engaging teeth;

wherein the steering column components are configured to be relatively tiltable around the protrusions and the tilting of the steering column components is restricted by the fastening device;

wherein the fastening device is configured to perpendicularly penetrate the contact surfaces;

wherein one of the steering column components includes a second elongated hole which penetrates the one of the steering column components in the front-and-rear direction and is elongated in the longitudinal direction of the steering column, and the fastening device is inserted through the second elongated hole;

wherein the tilting of the steering column components is allowed by loosening the fastening device;

wherein the steering column components are each configured to be in substantially a channel shape opened in a transverse cross-section, substantially in the longitudinal direction of the watercraft, and are configured so that a portion of one component is inside a portion of the other; and wherein one of the contact surfaces is provided in a front surface of a web portion of one of the channel-shaped steering column components and the other contact surface is provided on a rear surface of a web portion of the other channel-shaped steering column component, and the contact surfaces are configured to be exposed when the steering components are titled.

10. The steering device of claim 9, wherein the steering column components are oriented so that the channel shapes thereof are opened forward.

11. The steering device of claim 9, wherein the lower steering column component is rotatably coupled with a body of the watercraft about the longitudinal axis thereof for an interlock movement with a steering nozzle of the watercraft, and wherein a portion of the lower steering column component is arranged inside a portion of the upper steering column component; and wherein the upper steering column component is configured to be movable in the longitudinal direction of the steering column and tiltable rearward, with respect to the lower steering column component.

* * * * *